US006312228B1

(12) United States Patent
Mori et al.

(10) Patent No.: US 6,312,228 B1
(45) Date of Patent: Nov. 6, 2001

(54) RECOVERY PUMP FOR RECOVERING FLOATING OIL

(75) Inventors: Yoji Mori, Chiba; Masami Hashimoto, Ibaraki, both of (JP)

(73) Assignee: World Chemical Co., Ltd., Tokyo (JP)

( * ) Notice: Subject to any disclaimer, the term of this patent is extended or adjusted under 35 U.S.C. 154(b) by 0 days.

(21) Appl. No.: 09/478,640

(22) Filed: Jan. 6, 2000

(30) Foreign Application Priority Data

Mar. 30, 1999 (JP) ..... 11-089756

(51) Int. Cl.[7] ..... F04B 53/00
(52) U.S. Cl. ..... 417/61; 210/109
(58) Field of Search ..... 210/221.2, 219, 210/96.1, 242.3, 651, 787, 122, 97, 109, 220; 415/7; 417/61, 40, 569; 134/111

(56) References Cited

U.S. PATENT DOCUMENTS 3,598,501 * 8/1971 Stanfield ..... 415/7
3,722,687 * 3/1973 Stebbins et al. ..... 210/219
3,753,492 * 8/1973 Aiello et al. ..... 210/96.1
3,762,557 * 10/1973 Tudor et al. ..... 210/242.3
3,800,951 * 4/1974 Mourlon et al. ..... 210/242.3
4,038,182 * 7/1977 Jenkins ..... 210/651
4,089,620 * 5/1978 Ravitts ..... 417/61
4,142,972 * 3/1979 Nebeker et al. ..... 210/787
4,651,762 * 3/1987 Bowden ..... 134/111
4,789,307 * 12/1988 Sloan ..... 417/40
5,141,632 * 8/1992 Catcher ..... 210/122
5,160,605 * 11/1992 Noestheden ..... 210/97
5,207,897 * 5/1993 Baird et al. ..... 210/109
5,244,365 * 9/1993 Catcher ..... 417/569
5,527,461 * 6/1996 Hill ..... 210/220
5,954,955 * 9/1999 Mori et al. ..... 210/221.2

* cited by examiner

*Primary Examiner*—Teresa Walberg
*Assistant Examiner*—Leonid M Fastovsky
(74) *Attorney, Agent, or Firm*—Steinberg & Raskin, P.C.

(57) ABSTRACT

A recovery pump capable of reliably recovering floating oil and/or floating matter such as scum or the like while being significantly down-sized. A pump casing is provided in a lower section thereof with a suction passage and a discharge passage. The suction passage is horizontally arranged and has a suction opening and the discharge passage is horizontally arranged below the suction passage. The passages are arranged so as to communicate with each other through a through-hole and the discharge passage is provided therewithin right below the through-hole with an impeller, which is driven by a drive motor located on an upper section of the pump casing. The suction opening is provided with a recovery section for recovering the floating oil and/or floating matter.

7 Claims, 6 Drawing Sheets

RECOVERY PUMP FOR RECOVERING FLOATING OIL

BACKGROUND OF THE INVENTION

This invention relates to a recovery pump, and more particularly to a recovery pump for recovering floating oil and/or floating matter such as scum or the like, which float on a surface of liquid.

For the purpose of recovering floating oil and/or floating matter such as scum or the like, which float on a surface of liquid, a recovery apparatus has been conventionally practiced, which is so constructed that a recovery section provided with an inflow port for recovering floating oil and/or floating matter therethrough is floated on a surface of liquid by means of a float and the inflow port of the recovery section is connected to a pump arranged on a ship, land or the like through a hose.

Unfortunately, the conventional recovery apparatus requires an increased space for installation because the recovery section and pump are separated from each other and the recovery section and pump are connected to each other through the hose. In order to eliminate such a disadvantage, a recovery apparatus is proposed which is constructed as disclosed in Japanese Utility Model Publication No. 13603/1977. More particularly, in the proposed recovery apparatus, a pump is integrally supported on a float body formed with an inflow passage for guiding floating oil and/or floating matter therethrough to the pump. However, the recovery apparatus has a problem of requiring to increase a size of the float depending on a weight of the pump, resulting in the recovery apparatus being large-sized as a whole.

SUMMARY OF THE INVENTION

The present invention has been made in view of the foregoing disadvantage of the prior art.

Accordingly, it is an object of the present invention to provide a recovery pump for recovering floating oil and/or floating matter which pump is capable of being significantly down-sized.

It is another object of the present invention to provide a recovery pump which is capable of positively recovering floating oil and/or floating matter such as scum or the like, which float on a surface of liquid.

In accordance with the present invention, a recovery pump for recovering floating oil is provided. The recovery pump includes a pump casing formed in a lower section thereof with a suction passage which horizontally extends and has a suction opening. The pump casing is formed in the lower section thereof with a discharge passage in such a manner as to be positioned below the suction passage and horizontally extend. Also, the pump casing is formed therein with a through-hole which permits the suction passage and discharge passage to communicate with each other therethrough. The recovery pump also includes an impeller rotatably arranged within the discharge passage right below the through-hole, a drive motor arranged on an upper section of the pump casing for rotating the impeller, and a recovery section arranged at the suction opening for recovering the floating oil and/or floating matter such as scum or the like therethrough.

In a preferred embodiment of the present invention, the impeller is indirectly rotated following rotation of the drive motor.

In a preferred embodiment of the present invention, the recovery section is constituted by a pipe body vertically mounted to the suction opening, a slide pipe provided with an inflow port, and a float. The slide pipe is slidably mounted on the pipe body and arranged so as to float in liquid while being supported by the float.

In a preferred embodiment of the present invention, the inflow port is formed on one side of a central portion thereof with a constriction. The constriction is formed with a V-shaped groove in a manner to outwardly face. The V-shaped groove includes a bottom formed so as to be upwardly inclined toward the inflow port.

In a preferred embodiment of the present invention, the pump further includes a scraping-up means positioned to face the inflow port for scraping up the floating oil and/or floating matter to make them flow into the recovery section and an additional motor for driving said scraping-up means.

BRIEF DESCRIPTION OF THE DRAWINGS

These and other objects and many of the attendant advantages of the present invention will be readily appreciated as the same becomes better understood by reference to the following detailed description when considered in connection with the accompanying drawings; wherein.

DESCRIPTION OF THE PREFERRED EMBODIMENT

Figure 1:
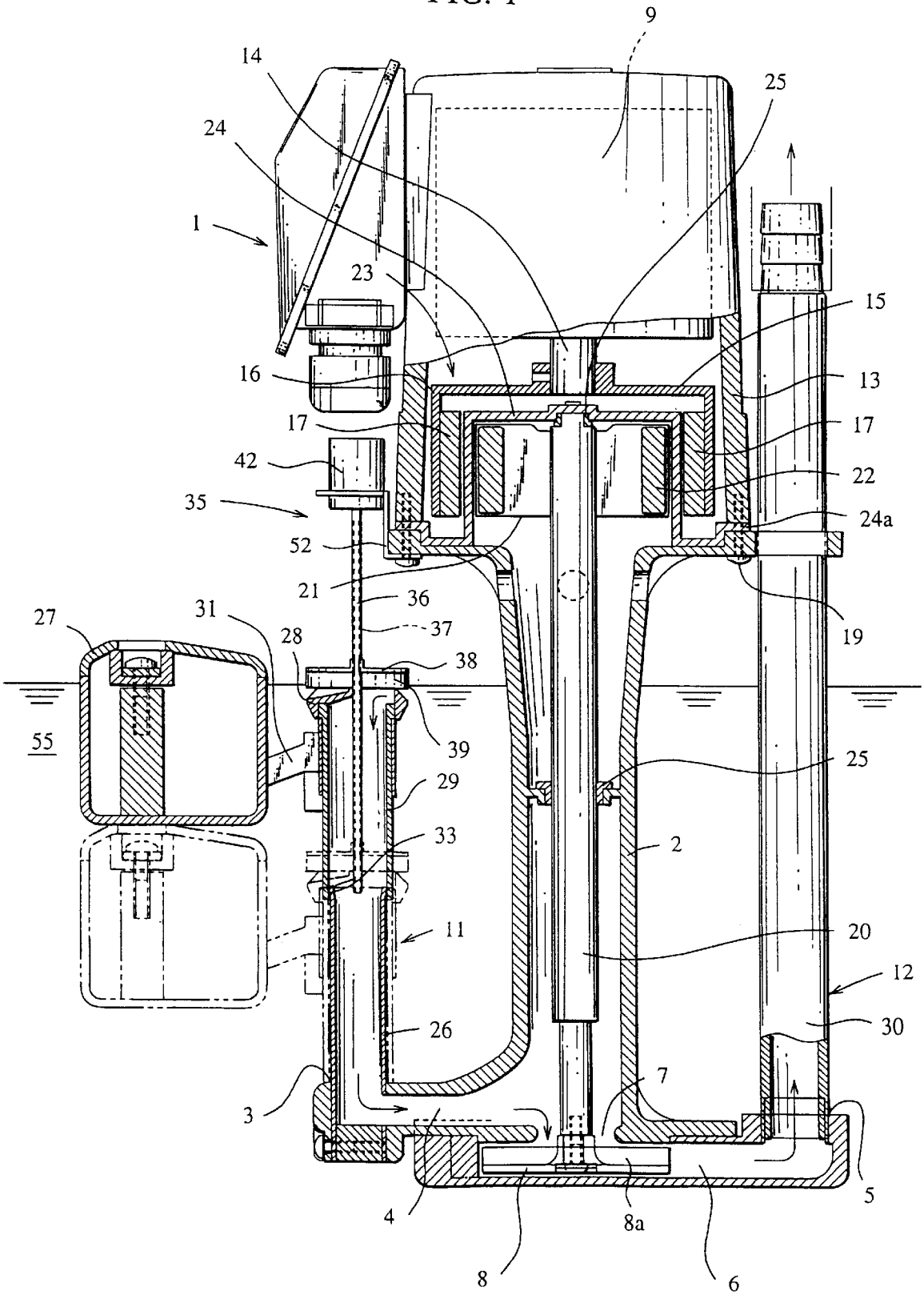
FIG. 1 is a schematic front elevation view partly in section showing an embodiment of a recovery pump according to the present invention.

Now, a recovery pump for recovering floating oil according to the present invention will be described hereinafter with reference to the accompanying drawings.

Referring first to FIGS. 1 to 5B, an embodiment of a recovery pump for recovering floating oil according to the present invention is illustrated. A recovery pump of the illustrated embodiment which is generally designated at reference numeral 1 in FIG. 1 includes a pump casing 2. The pump casing 2 is provided in a portion thereof extending from a central portion of a lower section thereof over a left-hand side thereof based on the central portion in FIG. 1 with a suction passage 4. The suction passage 4 is formed with a suction opening 3 and arranged so as to extend in a horizontal direction. Also, the pump casing 2 is provided in a portion thereof extending from the central portion of the lower section thereof over a right-hand side thereof based on the central portion with a discharge passage 6. The discharge passage 6 is formed with a discharge opening 5 and arranged so as to extend in a horizontal direction.

Figure 4:
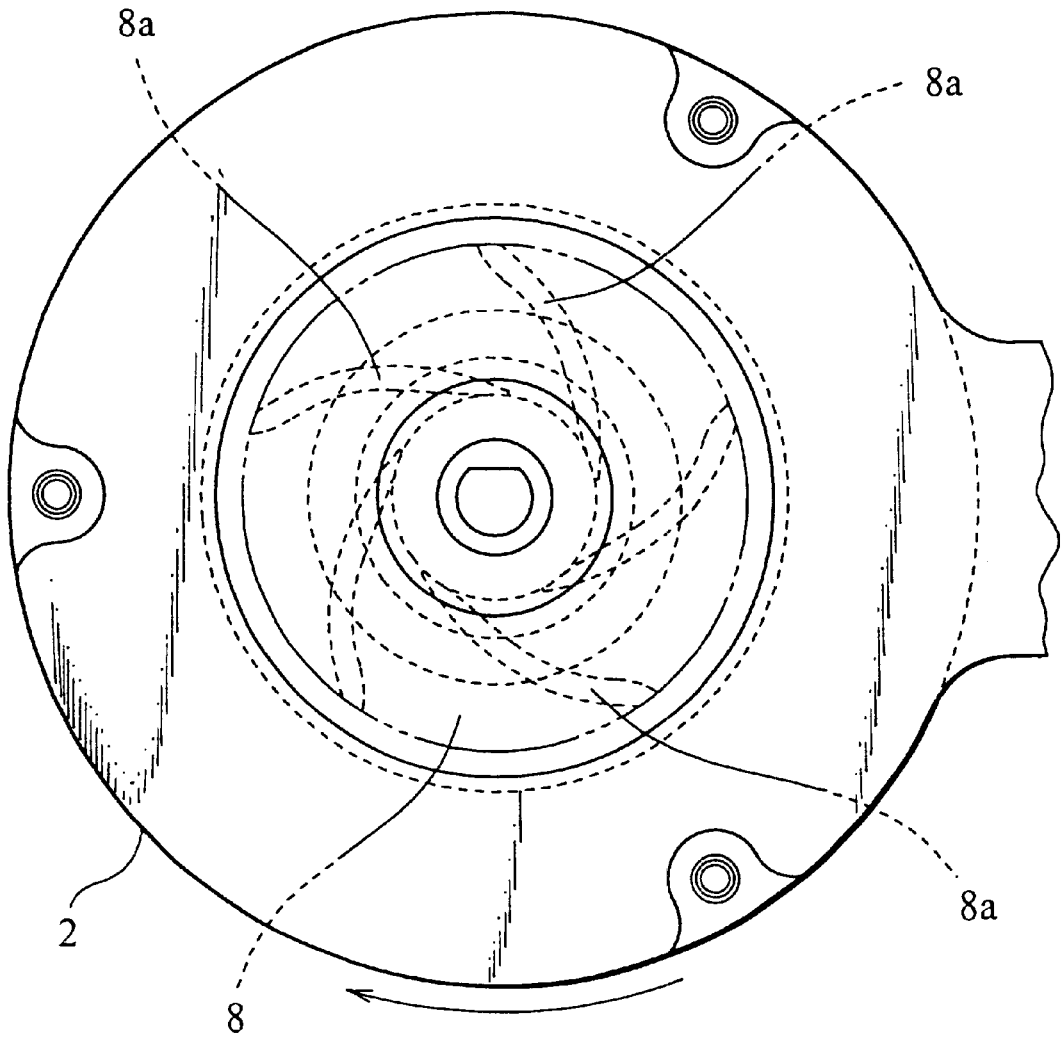
FIG. 4 is a plan view showing an impeller.

The suction passage 4 and discharge passage 6 are so arranged that a downstream portion of the suction passage 4 and an upstream portion of the discharge passage 6 vertically overlap each other to provide an overlap. The pump casing 2 is provided with a through-hole 7, which is positioned at the overlap to permit the suction passage 4 and discharge passage 6 to communicate with each other therethrough. The discharge passage 6 has an impeller 8 arranged therewithin in a manner to be positioned right below the through-hole 7. The impeller 8 is rotatedly driven by a drive motor 9 which is arranged on an upper section of the pump casing 2 so as to act as a drive source for the impeller 8. The impeller 8 is provided on an upper surface thereof with a plurality of open blades 8*a* so as to radially extend in a swirl-like manner, as shown in FIG. 4.

The suction opening 3 is arranged on an upper surface of an upstream portion of the suction passage 4 and provided with a recovery section 11 for recovering floating oil and/or floating matter such as scum or the like, which float on a surface of liquid. Also, the discharge opening 5 is arranged on an upper surface of a downstream portion of the discharge passage 6 and provided with a discharge section 12 for discharging the floating oil and/or floating matter.

The motor 9 is received in a motor casing 13 constructed so as to exhibit complete water-tightness. The motor 9 includes an output shaft 14, which is fixedly mounted on a distal end thereof with a rotary disc 15. The rotary disc 15 is integrally provided around an outer periphery thereof with a wall 16 so as to downwardly extend therefrom. The wall 16 is mounted on an inner peripheral surface thereof with magnets 17 in a manner to be spaced from each other at predetermined intervals. The impeller 8 is supported on a lower end of a revolving shaft 20 arranged in a manner to vertically extend. The revolving shaft 20 is mounted on an upper end thereof with a rotary disc 21, which is positioned in proximity to a lower surface of the rotary disc 15 fixed on the distal end of the output shaft 14 of the motor 9. The rotary disc 21 has magnets 22 embedded in a peripheral surface thereof in a manner to correspond to the magnets 17 fixed on the inner peripheral surface of the wall 16.

The magnets 17 may be arranged on the whole inner peripheral surface of the wall 16. Correspondingly, the magnets 22 may be arranged on the whole peripheral surface of the rotary disc 15.

The magnets 17 arranged on the wall 16 of the rotary disc 15 fixed on the output shaft 14 of the motor 9 and the magnets 22 arranged on the peripheral surface of the rotary disc 21 fixed on the revolving shaft 20 on which the impeller 8 is supported cooperate with each other to provide a magnet coupling 23. Between the magnets 17 and the magnets 22 which constitute the magnet coupling 23 described above is arranged a partition plate 24 which is formed to have a substantially inverted U-shape in section. The partition plate 24 is outwardly bent at a lower portion thereof, to provide a flange-like peripheral edge 24*a*. The peripheral edge 24*a* is positioned at an engagement between the motor casing 1 and the pump casing 2 and integrally attached to the motor casing 13 and pump casing 2 by means of fixtures or headed bolts 19. Such arrangement permits the motor casing 13 to exhibit satisfactory water- or liquid-tightness sufficient to prevent liquid from intruding the motor casing 13.

The impeller 8 is arranged so as to be indirectly rotated following rotation of the motor 9 by the magnet coupling 23. The revolving shaft 20 of the impeller 8 is supported by bearings 25 and 25 provided on a central portion of the pump casing 2 and a rear surface of a central portion of the shield plate 24, respectively.

The recovery section 11 is constituted by a pipe body 26 vertically mounted to the suction opening 3 of the suction passage 4 and a slide pipe 29 slidably mounted on the pipe body 26 and arranged so as to be floated in liquid while being supported by a pair of floats 27. The slide pipe 29 is formed with an inflow port 28. The slide pipe 29 is arranged in a manner to be prevented from being released or detached from the pipe body 26. The pipe body 26 is formed on a periphery of an upper portion thereof with a seal 33. The discharge section 12 is constituted by a pipe 30 vertically arranged at the discharge opening 5 of the discharge passage 6.

The pipe body 26 and slide pipe 29 may be replaced with ones having different lengths as required.

Figure 3:
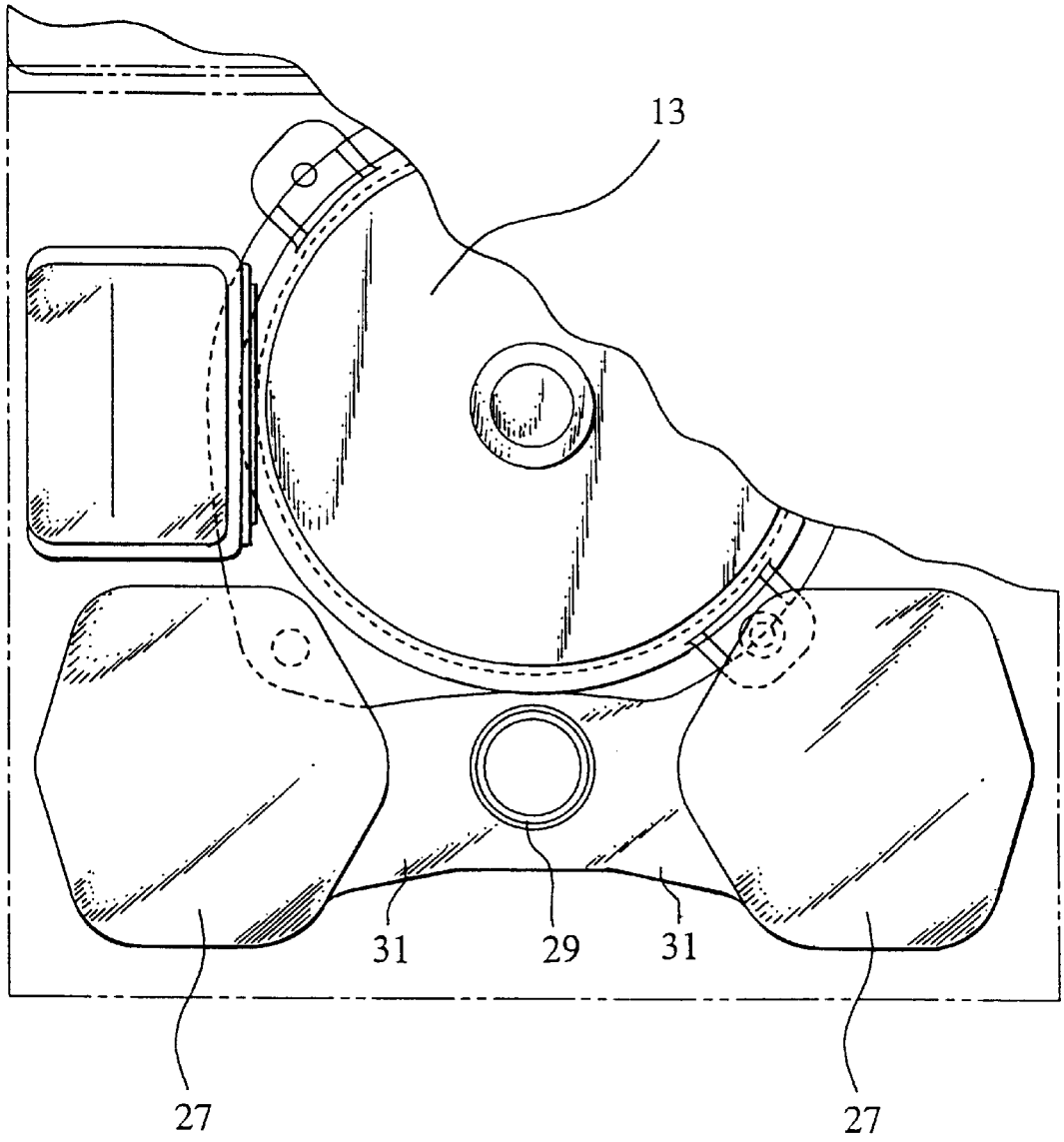
FIG. 3 is a plan view of the recovery pump shown in FIG. 1 of which a part is omitted for the sake of brevity.
Figure 5A:
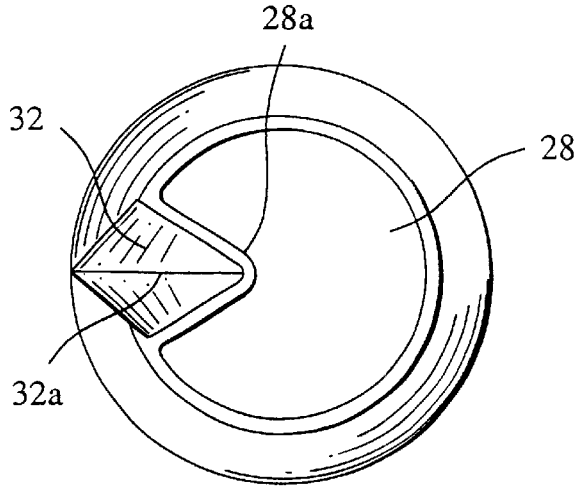
FIG. 5A is a plan view showing an inflow port in a recovery section.
Figure 5B:
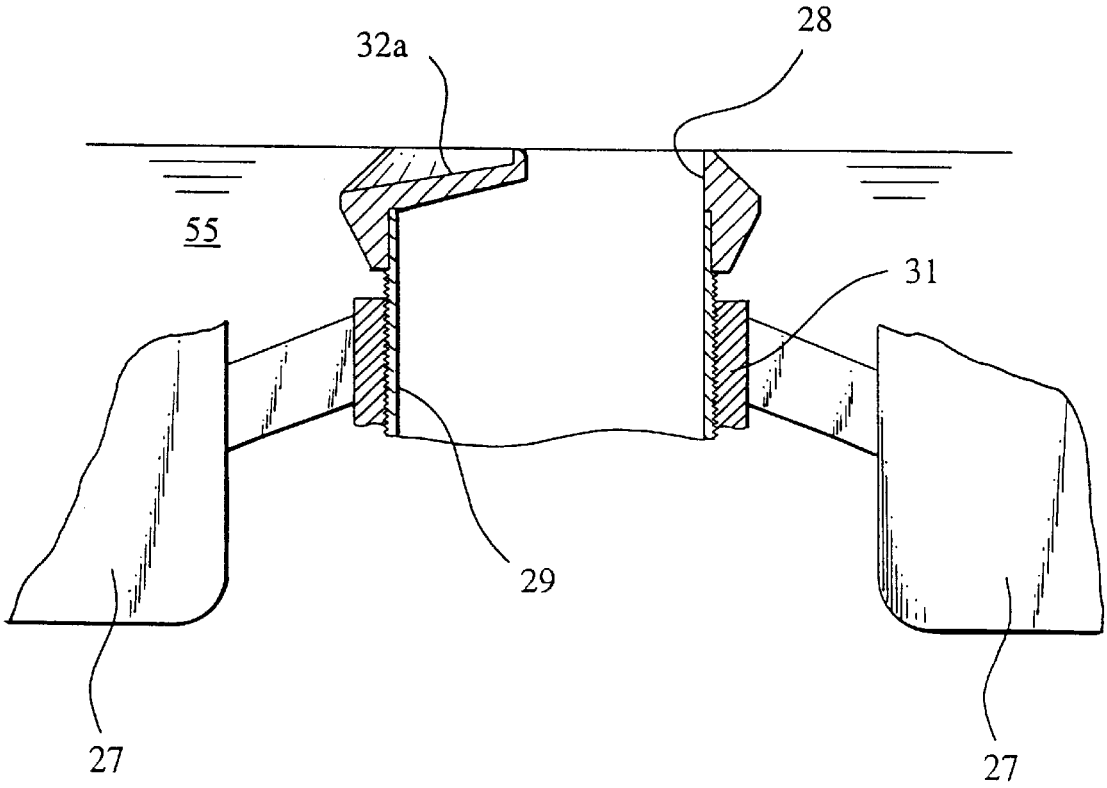
FIG. 5B is a vertical sectional view of the inflow port shown in FIG. 5A.

The slide pipe 29, as shown in FIGS. 1, 3 and 5B, has a support member 31 threadedly mounted thereon, which support member 31 is arranged so as to support the pair of floats 27 thereon, so that turning of the support member 31 permits the floats 27 to be vertically finely adjusted with respect to a surface of liquid. Also, the inflow port 28 arranged at the upper portion of the slide pipe 29 is so formed that one side of a central portion thereof is constricted, to thereby provide a constriction 28*a*. The constriction 28*a* is formed with a V-shaped groove 32 in a manner to outwardly face. Thus, the V-shaped groove 32 includes a bottom 32*a* formed so as to be upwardly inclined toward the inflow port 28.

Alternatively, the inflow port 28 may be constricted on both sides of the central portion thereof to form a substantially butterfly-like shape or constricted in a cross-like manner as viewed in plan.

The recovery pump also includes a scraping-up means 35 positioned to face the inflow port 28 for scraping up floating oil and/or floating matter such as scum or the like to make them flow into the recovery section 11. The scraping-up means 35 is driven by means of a water-tight motor 40 acting as a drive source therefor. The scraping-up means 35 is constituted by a revolving shaft 36 formed on opposite sides thereof with grooves 37 so as to extend in an axial direction of the revolving shaft 36, a movable member 38 arranged so as to be vertically movable while being guided by the grooves 37, and scraping-up blades 39 fixed on the movable member 38 using any suitable fixing means such as welding, screws, adhesion or the like.

The scraping-up blades 39 may be made of, without limitation, metal, resin, rubber or the like.

Figure 2:
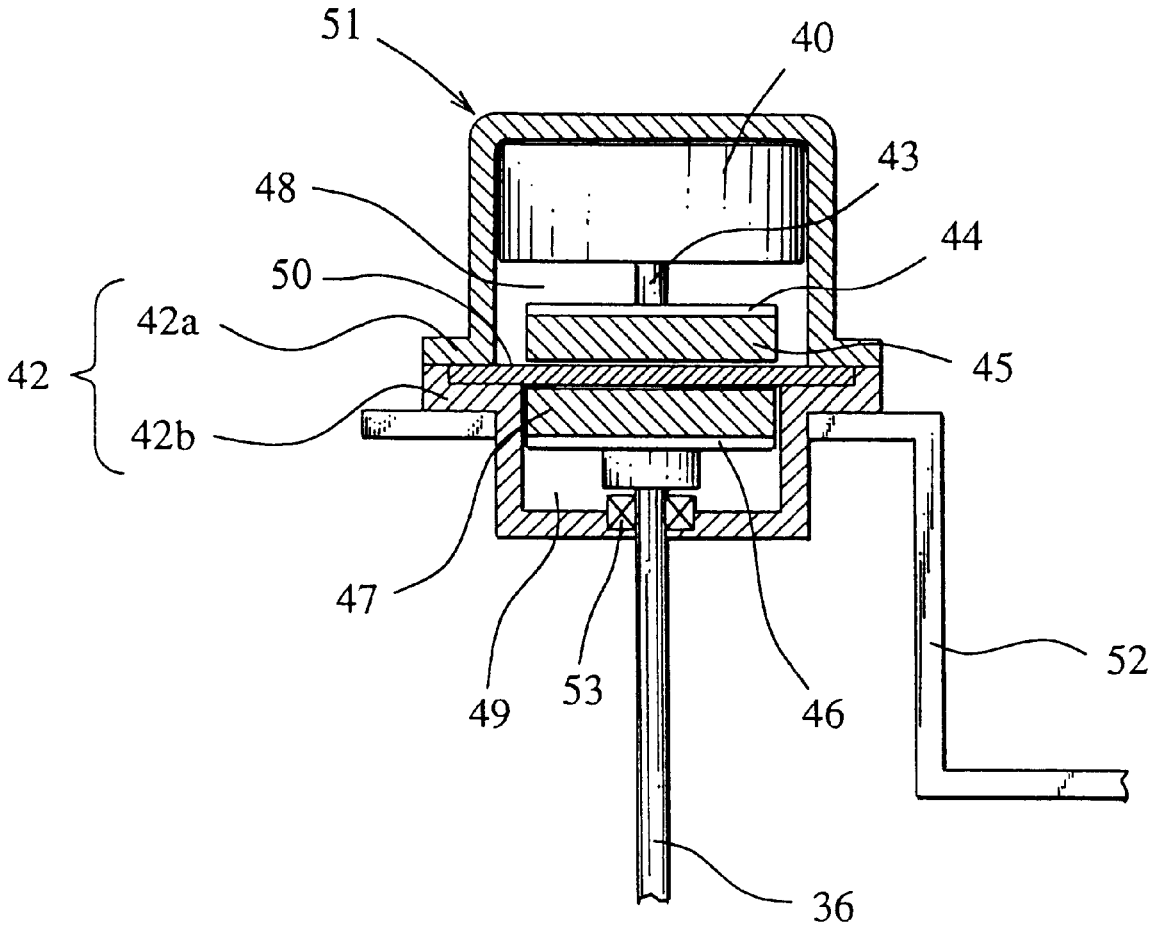
FIG. 2 is a sectional view showing an internal structure of a motor for driving a scraping-up means incorporated in the recovery pump of FIG. 1.

The revolving shaft 36 of the scraping-up means 35 is arranged so as to be indirectly rotated following rotation of the motor 40. More particularly, the motor 40, as shown in FIG. 2, is received in an upper chamber 48 defined in a motor casing 42 constructed so as to exhibit complete water-tightness and includes an output shaft 43. The output shaft 43 is fixedly mounted on a distal end thereof with a rotary disc 44, which is securely mounted on a lower surface thereof with a magnet 45. The revolving shaft 36 on which the movable member 38 having the scraping-up blades 39 fixed thereon is mounted is fixedly mounted on an upper end thereof with a rotary disc 46, which is then received in a lower chamber 49 defined in the motor casing 42. The rotary disc 46 has a magnet 47 securely fixed on an upper surface thereof in a manner to correspond to the magnet 45.

The motor casing 42 is constituted by securely connecting two casing members 42*a* and 42*b* to each other using any suitable fixing means such as a combination of bolts and nuts (not shown) or the like. Reference numeral 50 designates a partition plate arranged at an engagement formed between the casing members 42*a* and 42*b* by the above-described connection of the casing members. The partition plate 50 permits the motor casing 42 to be divided into the upper chamber 48 and lower chamber 49 described above and prevents liquid from intruding into the upper chamber 48. The motor casing 42 is supported by a bracket member 52 mounted on the pump casing 2.

The magnet 45 provided on the rotary disc 44 fixed on the output shaft 43 of the motor 40 and the magnet 47 arranged on the rotary disc 46 fixed on the upper end of the revolving shaft 36 on which the scraping-up blades 39 are mounted cooperate with each other to provide a magnet coupling 51. The thus-provided magnet coupling 51 permits the revolving shaft 36 on which the scraping-up blades 39 are mounted to be indirectly rotated following rotation of the motor 40 therethrough. The revolving shaft 36 is supported by a bearing 53 arranged at a lower central portion of the lower chamber 49 of the motor casing 42.

Now, the manner of operation of the recovery pump of the illustrated embodiment thus constructed will be described.

First, as shown in FIG. 1, the pump 1 is placed in liquid 55 in which floating oil and/or floating matter such as scum or the like exists. In this instance, the inflow port 28 of the recovery section 11 is positioned in correspondence to a surface of the liquid 55. Then, the pump 1 is operated while being controlled, resulting in the liquid flowing through the inflow port 28 into the recovery section 11 together with the floating oil and/or floating matter. Then, the liquid is guided through the suction passage 4 to the discharge passage 6 and then outwardly discharged through the pipe 30 of the discharge section 12.

Floating matter such as scum or the like generally tends to be hard to enter the recovery section 11 through the inflow port 28. However, the illustrated embodiment, as described above, is so constructed that the inflow port 28 is formed on one side of the central portion thereof with the constriction 28*a,* which is provided with the V-shaped groove 32. Such construction permits the floating matter to be guided into the V-shaped groove 32, to thereby be collected therein, so that rotation of the scraping-up blades 39 of the scraping-up means 35 permits the floating matter to be forcibly scraped up and upwardly moved along an inclined surface of the V-shaped groove 32, resulting in the floating matter being, together with floating oil, reliably introduced into the recovery section 11 for recovery.

The scraping-up blades 39 of the scraping-up means 35 are arranged so as to be vertically movable with respect to the revolving shaft 36, to thereby be moved following fluctuation of the surface of the liquid 55.

The motors 9 and 40 are received in the water-tight motor casings 13 and 42, respectively, to thereby be effectively used in a moist environment.

Further, the output shaft 14 of the motor 9 and the revolving shaft 20 on which the impeller 8 is supported are operatively associated with each other through the magnet coupling 23, to thereby prevent an accident such as a failure in rotation of the impeller 8 due to catching of trash or the like on the impeller or the like from adversely affecting the motor 9.

Likewise, the output shaft 43 of the motor 40 and the revolving shaft 36 on which the scraping-up blades 39 are mounted are operatively associated with each other through the magnet coupling 51, to thereby prevent a failure in rotation of the scraping-up blades 39 due to catching of trash or the like thereon from adversely affecting the motor 40.

Also, in the illustrated embodiment, the recovery section 11 is integrally provided on the pump casing 2, leading to downsizing of the recovery pump.

Figure 6:
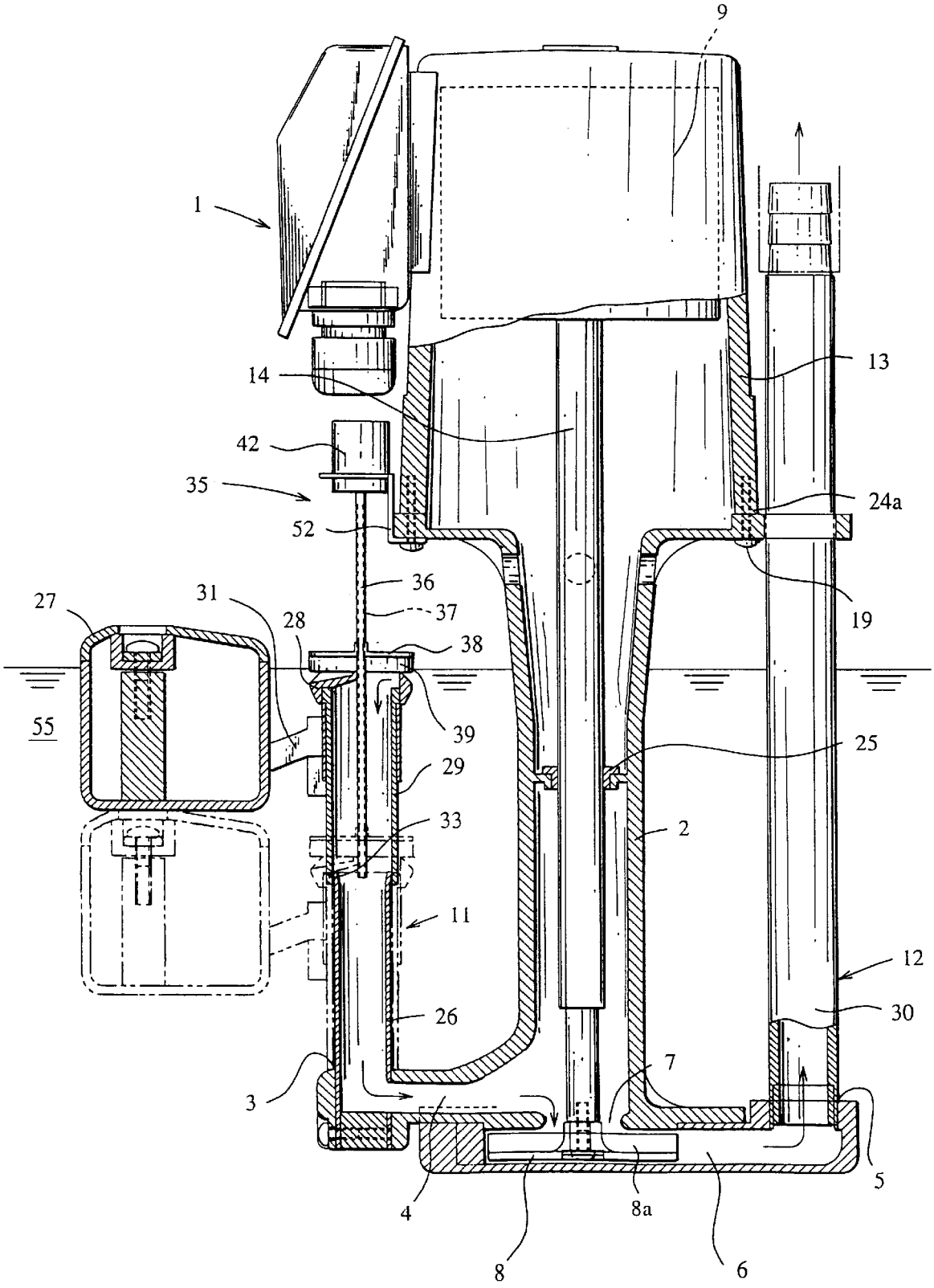
FIG. 6 is a schematic front elevation view partly in section showing another embodiment of a recovery pump according to the present invention.

Referring now to FIG. 6, another embodiment of a recovery pump according to the present invention will be illustrated. In a recovery pump of the illustrated embodiment, an output shaft 14 of a motor 9 is positioned at a distal end thereof in proximity to a through-hole 7 which permits a suction passage 4 and a discharge passage 6 each formed in a lower section of a pump casing 2 to communicate with each other therethrough, so that an impeller 8 is directly attached to the distal end of the output shaft 14 so as to be arranged in a portion of the discharge passage 6 located right below the through-hole 7.

The remaining part of the illustrated embodiment may be constructed in substantially the same manner as the embodiment described above.

The recovery pump of the illustrated embodiment thus constructed permits rotating force of the motor 9 to be transmitted directly to the impeller 8, to thereby ensure reliable rotation of the impeller 8, because the impeller 8 is connected directly to the output shaft 14 of the motor 9.

Floating matter such as scum or the like generally tends to be hard to enter a recovery section 11 through an inflow port 28. However, in the illustrated embodiment as well, the inflow port 28 is formed on one side of a central portion thereof with a constriction 28*a,* which is provided with a V-shaped groove 32. Such construction permits the floating matter to be guided into the V-shaped groove 32, to thereby be collected therein, so that rotation of scraping-up blades 39 of a scraping-up means 35 permits the floating matter to be forcibly scraped up and upwardly transferred along an inclined surface of the V-shaped groove 32, resulting in the floating matter being reliably introduced into the recovery section 11 for recovery as well as floating oil.

The scraping-up blades 39 of the scraping-up means 35 are arranged so as to be vertically movable with respect to a revolving shaft 36, resulting in their being moved following fluctuation of a surface of liquid 55.

The motor 9 and a motor 40 are received in water-tight motor casings 13 and 42, respectively, to thereby be satisfactorily used in a moist environment.

As can be seen from the foregoing, the recovery pump of the present invention is so constructed that the pump casing is provided on the upper section thereof with the drive motor for driving the impeller arranged right below the through-hole which permits overlapped portions of the suction passage and discharge passage to communicate with each other therethrough and the recovery section for recovering floating oil and/or floating matter is integrally provided in the lower section of the pump casing. Such construction leads to down-sizing of the recovery pump. In addition, arrangement of the recovery section at the suction opening in the present invention ensures reliable recovery of the floating oil and/or floating matter in liquid.

Also, in the present invention, the impeller may be indirectly rotated following rotation of the drive motor. This prevent an accident such as a failure in rotation of the impeller due to catching of the floating matter on the impeller or the like from adversely affecting the motor.

Further, the present invention may be so constructed that the recovery section is constituted by the pipe body vertically mounted to the suction opening and the slide pipe slidably mounted on the pipe body and arranged so as to float in liquid while being supported by the float, wherein the slide pipe is provided with the inflow port. Such construction permits the recovery pump to be effectively operated while being accommodated to fluctuation of a surface of liquid due to wind or the like.

Furthermore, in the present invention, the inflow port may be so formed that one side of the central portion thereof is provided with the constriction, which is formed with the V-shaped groove in a manner to outwardly face. The V-shaped groove includes the bottom formed so as to be upwardly inclined toward the inflow port. Such arrangement ensures positive recovery of the floating oil and/or floating matter through the V-shaped groove.

Moreover, the recovery pump of the present invention may include the scraping-up means positioned to face the inflow port for scraping up the floating oil and/or floating matter to make it flow into the recovery section. This permits the floating oil and/or floating matter to be forcibly recovered.

While preferred embodiments of the invention have been described with a certain degree of particularity with reference to the drawings, obvious modifications and variations are possible in light of the above teachings. It is therefore to be understood that within the scope of the appended claims, the invention may be practiced otherwise than as specifically described.

What is claimed is:

1. A recovery pump for recovering at least one of floating oil and floating matter, comprising:

a pump casing formed in a lower section thereof with a suction passage which horizontally extends and has a suction opening, said pump casing being formed in said lower section thereof with a discharge passage in such a manner as to be positioned below said suction passage and horizontally extend, said pump casing being formed therein with a through-hole which permits said suction passage and discharge passage to communicate with each other therethrough;

an impeller rotatable arranged right below said through-hole within said discharge passage;

a drive motor arranged on an upper section of said pump casing for rotating said impeller; and a recovery section arranged at said suction opening for recovering at least one of the floating oil and the floating matter therethrough.

2. A recovery pump as defined in claim 1, wherein said impeller is indirectly rotated following rotation of said drive motor.

3. A recovery pump as defined in claim 1, wherein said recovery section includes a pipe body vertically mounted to said suction opening, a slide pipe provided with an inflow port, and a float, said slide pipe being slidably mounted on said pipe body and arranged so as to float in liquid while being supported by said float.

4. A recovery pump as defined in claim 3, wherein said inflow port is formed on one side of a central portion thereof with a constriction;

said constriction being formed with a V-shaped groove in a manner to outwardly face;

said V-shaped groove including a bottom formed so as to be upwardly inclined toward said inflow port.

5. A recovery pump as defined in claim 3, further comprising a scraping-up means positioned to face said inflow port for scraping up the at least one of the floating oil and the floating matter to make them flow into said recovery section and an additional motor for driving said scraping means.

6. A recovery pump as defined in claim 4, further comprising a scraping-up means positioned to face said inflow port for scraping up the at least one of the floating oil and the floating matter to make them flow into said recovery section and an additional motor for driving said scraping-up means.

7. A recovery pump as defined in claim 1, wherein the floating matter is scum.

* * * * *